US011352839B2

(12) United States Patent
Donzier et al.

(10) Patent No.: US 11,352,839 B2
(45) Date of Patent: Jun. 7, 2022

(54) PRODUCTION LOGGING TOOL AND DOWNHOLE FLUID ANALYSIS PROBES DEPLOYING METHOD

(71) Applicant: OPENFIELD, Versailles (FR)

(72) Inventors: Eric Donzier, Bercheres sur Vesgre (FR); Linda Abbassi, Katy, TX (US); Emmanuel Tavernier, Paris (FR)

(73) Assignee: OPENFIELD, Versailles (FR)

( * ) Notice: Subject to any disclaimer, the term of this patent is extended or adjusted under 35 U.S.C. 154(b) by 30 days.

(21) Appl. No.: 16/865,344

(22) Filed: May 2, 2020

(65) Prior Publication Data

US 2020/0362645 A1 Nov. 19, 2020

(30) Foreign Application Priority Data

May 4, 2019 (EP) ..... 19305571

(51) Int. Cl.
*E21B 17/10* (2006.01)
*E21B 47/01* (2012.01)

(52) U.S. Cl.
CPC ..... *E21B 17/1021* (2013.01); *E21B 17/1057* (2013.01); *E21B 47/01* (2013.01)

(58) Field of Classification Search
CPC .. E21B 17/1051; E21B 17/1057; E21B 47/01; E21B 17/1021
See application file for complete search history.

(56) References Cited

U.S. PATENT DOCUMENTS 4,557,327 A 12/1985 Kinley et al.
4,595,055 A 6/1986 Vannier
5,531,112 A 7/1996 Young et al.
5,631,413 A 5/1997 Young et al.
2014/0014366 A1* 1/2014 Hallundbæk ..... E21B 4/18 166/381
2018/0003027 A1 1/2018 Donzier et al.
2020/0332606 A1* 10/2020 Santos ..... F16L 55/32

FOREIGN PATENT DOCUMENTS

EP 1344893 A2 9/2003
WO WO2017118748 A1 7/2017
WO WO2019077308 A1 4/2019

* cited by examiner

*Primary Examiner* — D. Andrews
(74) *Attorney, Agent, or Firm* — The Jansson Firm; Pehr B. Jansson

(57) ABSTRACT

A guiding sub-section (2) of a production logging tool (1) comprises a central rigid stem (30) having a first mechanical connector (33) at one end and a second mechanical connector (34) at an another end, and carrying a roller deploying arrangement (31) comprising multiple external articulated arms (35A, 35B, 35C) circumferentially distributed about said body, each articulated arm comprising a roller assembly (32A, 32B, 32C) adapted for contact with a wall (7) of the hydrocarbon well (4) and operable from a retracted configuration into a radially extended configuration. The roller assembly (32A, 32B, 32C) comprises an arm hinge (51) coupling a first arm part and a second arm part of each articulated arm (35A, 35B and 35C) and having an arm hinge axis (AA') substantially perpendicular to the longitudinal axis (XX'), a roller bearing (52) secured onto the arm hinge (51) and having a roller axis (BB') angled with respect to the hinge axis (AA'), and an anti-slippage friction roller (53) received onto the roller bearing (52) in a rotation free manner.

19 Claims, 8 Drawing Sheets

PRODUCTION LOGGING TOOL AND DOWNHOLE FLUID ANALYSIS PROBES DEPLOYING METHOD

TECHNICAL FIELD

The invention relates to a production logging tool and a downhole fluid analysis probes deploying method. Such a production logging tool is used to analyze a multiphase fluid mixture flowing from a hydrocarbon bearing zone into a hydrocarbon well. Such a production logging tool is adapted to be deployed in a hydrocarbon well comprising vertical sections, deviated well sections, horizontal well sections or a combination of the above. Production logging tools typically operate in the harsh downhole environment of hydrocarbon wells at downhole pressure (typically in the range of one hundred to 2000 bars) and temperature (typically in the range of 50 to 200° C.) conditions, and in corrosive fluids.

BACKGROUND

During the production of a hydrocarbon well, it is necessary to monitor various characteristic parameters, like the relative volumetric flow rates of the different phases (e.g. oil, gas and water) of the multiphase fluid mixture flowing into the pipe of the well from the hydrocarbon bearing zones. Further, current hydrocarbon wells often comprise a vertical well section, deviated well sections and sometimes horizontal well sections. The interpretation of the flow in such complex wells is challenging because small changes in the well deviation and the flow regime influence the flow profile. Thus, an accurate monitoring requires sensors or probes capable of imaging a surface section or a volume section of the pipe and providing an estimation of the surface section or the volume section occupied by each phase.

Production logging of hydrocarbon wells (e.g. oil and gas wells) has numerous challenges related to the complexity of the multiphasic flow conditions and the harshness of the downhole environment.

Gas, oil, water, mixtures flowing in wells, being either openhole or cased hole wells, will present bubbles, droplets, mist, segregated wavy, slugs structures depending on the relative proportions of phases ("holdup"), their velocities, densities, viscosities, as well as pipe dimensions and well deviations. In order to achieve a good understanding of the individual phases flowrates and determine the relative contributions of each zone along the well, an accurate mapping of fluids types and velocities is required over the whole section of the hole (openhole well portion) or pipe (cased well portion) at different depths (i.e. the measured depth is different from the true vertical depth and generally longer than true vertical depth, due to intentional or unintentional curves in the well).

Further, production issues greatly vary depending on reservoir types and well characteristics resulting in the need for a flexible production logging technology working with different types of sensing physics. For example, due to the phases segregation, deviated wells showing high water cuts require an accurate detection of thin oil layer at the uppermost portion of the pipe. Well deviation will have a strong impact on velocities and holdups.

Furthermore, high pressure, up to 2000 bars, high temperature, up to 200° C., corrosive fluid ($H_2S$, $CO_2$) put constraints on sensors and tool mechanics.

Furthermore, solids presence in flowing streams can damage equipments. In particular, the sand entrained from reservoir rocks will erode parts facing the fluid flow. Solids precipitated from produced fluids due to pressure and temperature changes, such as asphalthenes, paraffins or scales create deposits contaminating sensors so and/or blocking moving parts (e.g. spinners).

Furthermore, the tool deployment into the well can be difficult and risky. In highly deviated or horizontal wells, tools must be pushed along the pipe using coiled tubing or pulled using tractor which is difficult when tools are long and heavy. Pipes may be damaged by corrosion or rock stress which may create restrictions and other obstacles. During the logging operation, equipments can be submitted to high shocks. Thus, in such environments, it is highly preferable to have light and compact tools.

Furthermore, the cost is also an important parameter in order to provide an economically viable solution to well performance evaluation even in mature fields having low producing wells in process of depletion with critical water production problems.

With respect to the hereinbefore described challenges, the state of the art production logging equipments have limitations.

Certain production logging tools available on the market have limited or no pipe section imaging capabilities and work correctly only in near vertical wells. These tools use a gradiomanometer and/or capacitance sensor to identify fluid entries. Further, these tools use spinner rpm and insitu calibration data to compute holdups and flowrates.

Other production logging tools available on the market are intended to identify fluid types from local probe sensors (electrical or optical) and to compute the fluid velocities from miniaturized spinners. Some of these production logging tools comprise probes attached to the centralizer arms creating a two dimensional (2D) array of local measurements. Achieving sufficient coverage requires a large number of arms/probes which leads to complex and expensive designs, and complex tool maintenance. In addition, the measurements on different phases are made at different positions on a long tool string resulting in interpretation issues. Another production logging tool comprises a one dimensional (1D) array of sensors attached to a moving arm providing a scan of measurements along one line of the pipe section. Thus, the measurements coverage is limited and, depending on tool position, some production zone may be missed. The operation of such complex and costly tools results in important deployment difficulties that render compulsory the presence of highly trained engineering teams on the field.

Other attempts have been made to develop tools with rotating arms in order to improve coverage. The documents U.S. Pat. Nos. 5,531,112 and 5,631,413 describe a production logging tool for use within a well to determine fluid holdup of a multiphase fluid flow within the well. The production logging tool includes a plurality of sensors secured within a plurality of arms which radially extend from a tool housing to points distal from the tool housing. A plurality of sensors are included within the plurality of arms for detecting variations in fluid properties attributable to different flow constituents of the multiphase fluid flow along a path which circumscribes an exterior of the tool housing. The plurality of arms are rotated about the tool housing for moving these sensors through the path in order to ensure that the volumetric proportions of the different flow constituents of the multiphase fluid flow are accurately detected in highly deviated and in horizontal wells. Such production logging tools are complex apparatuses. Their reliability is problematic when taking into account the harsh downhole environment of hydrocarbon wells. In particular, the difficulty of operating motor/shafts mechanics under high pressure and complexity of rotating electrical connections kept such development at prototype level and technology has never been commercialized.

SUMMARY OF THE DISCLOSURE

It is an object of the invention to propose a production logging tool that overcomes one or more of the limitations of the existing apparatus, in particular that is structurally simple and reliable to operate whatever the downhole conditions.

According to one aspect, there is provided a guiding sub-section of a production logging tool, the production logging tool comprising a measuring sub-section provided with probe to analyze at least one property of a multiphase fluid mixture flowing in a hydrocarbon well, the guiding sub-section has an elongated cylindrical body shape of longitudinal axis and comprises a central rigid stem having a first mechanical connector at one end and a second mechanical connector at an another end, at least one being arranged to be coupled with said measuring sub-section, and carrying a roller deploying arrangement comprising multiple external articulated arms circumferentially distributed about said body, each articulated arm comprising a roller assembly adapted for contact with a wall of the hydrocarbon well and operable from a retracted configuration into a radially extended configuration, the centralizer arms being coupled at a first side to the first mechanical connector and at a second side to a sliding sleeve arranged to slide on the central rigid stem, an axial spring extending around the central rigid stem and being disposed in abutment between the second mechanical connector and the sliding sleeve, wherein the roller assembly comprises:

an arm hinge coupling a first arm part and a second arm part of each articulated arm and having an arm hinge axis substantially perpendicular to the longitudinal axis;

a roller bearing secured onto the arm hinge and having a roller axis angled with respect to the hinge axis; and an anti-slippage friction roller received onto the roller bearing in a rotation free manner;

such that running the production logging tool in the hydrocarbon well results in a rotation movement of the guiding sub-section and of the measuring sub-section about the longitudinal axis.

The roller axis may be angled with respect to the hinge axis according to an angle ranging from 5° to 25°.

The roller bearing may comprise an inclined through-hole to receive the arm hinge such as to set the angle.

The roller bearing may comprise an abutting head laterally blocking one side of the anti-slippage friction roller, the abutting head being provided with a locking pin engaging a hole into one part of the associated articulated arm such as to block the rotation of the roller bearing and set the angle at a determined value.

A flat ring and a retaining ring may be provided at another side of the anti-slippage friction roller, the retaining ring being snapped into place into a machined groove in the roller bearing laterally blocking another side of the anti-slippage friction roller.

The arm hinge may secure in place a first arm part and a second arm part of each articulated arm by a head on one side and hole/pin on the other side.

The anti-slippage friction roller may be a notched wheel, or a wheel comprising multiple teeth, or a wheel comprising multiple pins, or a wheel comprising multiple spikes so as to have a frictional engagement with the surface of the wall.

The guiding sub-section may further comprise an unhooking blade having an end secured to the central rigid stem and associated with a respective articulated arm and arranged to initiate or ease the unhooking of the articulated arms from the central rigid stem when the guiding sub-section proceeds from a retracted configuration to the radially extended configuration.

The guiding sub-section may further comprise a roller assembly receiving part positioned approximately in the middle of the central rigid stem having a collar shape and comprising a central recess and at least one longitudinal outward clearance associated with a connecting rib that are arranged on the circumference of the roller assembly receiving part to receive a roller assembly and its associated articulated arm.

According to a further aspect, there is provided a production logging tool to analyze at least one property of a multiphase fluid mixture flowing in a hydrocarbon well comprising at least one measuring sub-section having an elongated cylindrical housing shape and comprising a central pressure-resistant rigid housing carrying a centralizer arrangement including a plurality of centralizer arms circumferentially distributed about said housing and operable from a retracted position into a radially extended position, at least one downhole fluid properties analysis probe being secured on an inner or lateral face of each centralizer arm such as to expose a tip of said, at least one, probe to the multiphase fluid mixture flowing in the hydrocarbon well, wherein the production logging tool further comprises at least one guiding sub-section according to the invention.

According to still a further aspect, there is provided a method of deploying a production logging tool in a hydrocarbon well, comprising the steps of:

providing a production logging tool extending along a longitudinal axis comprising a measuring sub-section and a guiding sub-section, the measuring sub-section carrying a centralizer arrangement including a plurality of centralizer arms circumferentially distributed about said longitudinal axis and operable from a retracted position into a radially extended position of engagement with a wall of the well, at least one downhole fluid properties analysis probe being secured on an inner or lateral face of each centralizer arm such as to expose a tip of said, at least one, probe to a multiphase fluid mixture flowing in the hydrocarbon well, the guiding sub-section carrying a guiding arrangement including a plurality of articulated arms circumferentially distributed about said longitudinal axis and operable from a retracted position into a radially extended position of engagement with a wall of the well, the articulated arms having respective radially outermost portions configured to frictionally engage the wall of the well, running the production logging tool along the well while operating the centralizer arms and the articulated arms to radially extend into engagement with the wall of the well and to cause anti-slippage friction between said outermost portions of the articulated arms and the wall of the well, said outermost portions of the articulated arms are configured to cause the production logging tool to rotate around the longitudinal axis as a result of the running of the production logging tool along the well.

The outermost portions may be configured to rotate with respect to the respective articulated arms as a result of said friction around an axis angled with respect to the longitudinal axis of the production logging tool.

The production logging tool of the invention enables rotating the whole production logging tool, thus rotating the probes attached to it when the production logging tool is run into the well (the displacement of the tool results from the traction exerted by the cable or the coiled tubing). This rotation is obtained in a passive manner, namely without a specific motor/shaft mechanism within the production logging tool, but rather as a result of the upward (i.e. towards the surface of the well) or downward (i.e. towards the bottom of the well) movement of the production logging tool. This results in a simple and compact structure achieving low cost, easy operation and maintenance.

Further, the particular helicoidal movement of the probes (i.e. magnetic, optical, electrical, or ultrasonic type, or a combination of at least two of these types) that is obtained enables scanning circumference of the hydrocarbon well section in an efficient manner, therefore achieving a substantial coverage of the wellbore section and detecting thin layers of fluids produced while using a few number of probes. This is particularly advantageous in deviated and horizontal hydrocarbon well where fluid mixture (oil, gas, water) flows in a highly segregated manner.

Other advantages will become apparent from the hereinafter description of the invention.

DESCRIPTION OF THE DRAWINGS

The present invention is illustrated by way of examples and not limited to the accompanying drawings, in which like references indicate similar elements.

DETAILED DESCRIPTION OF THE INVENTION

Figure 1:
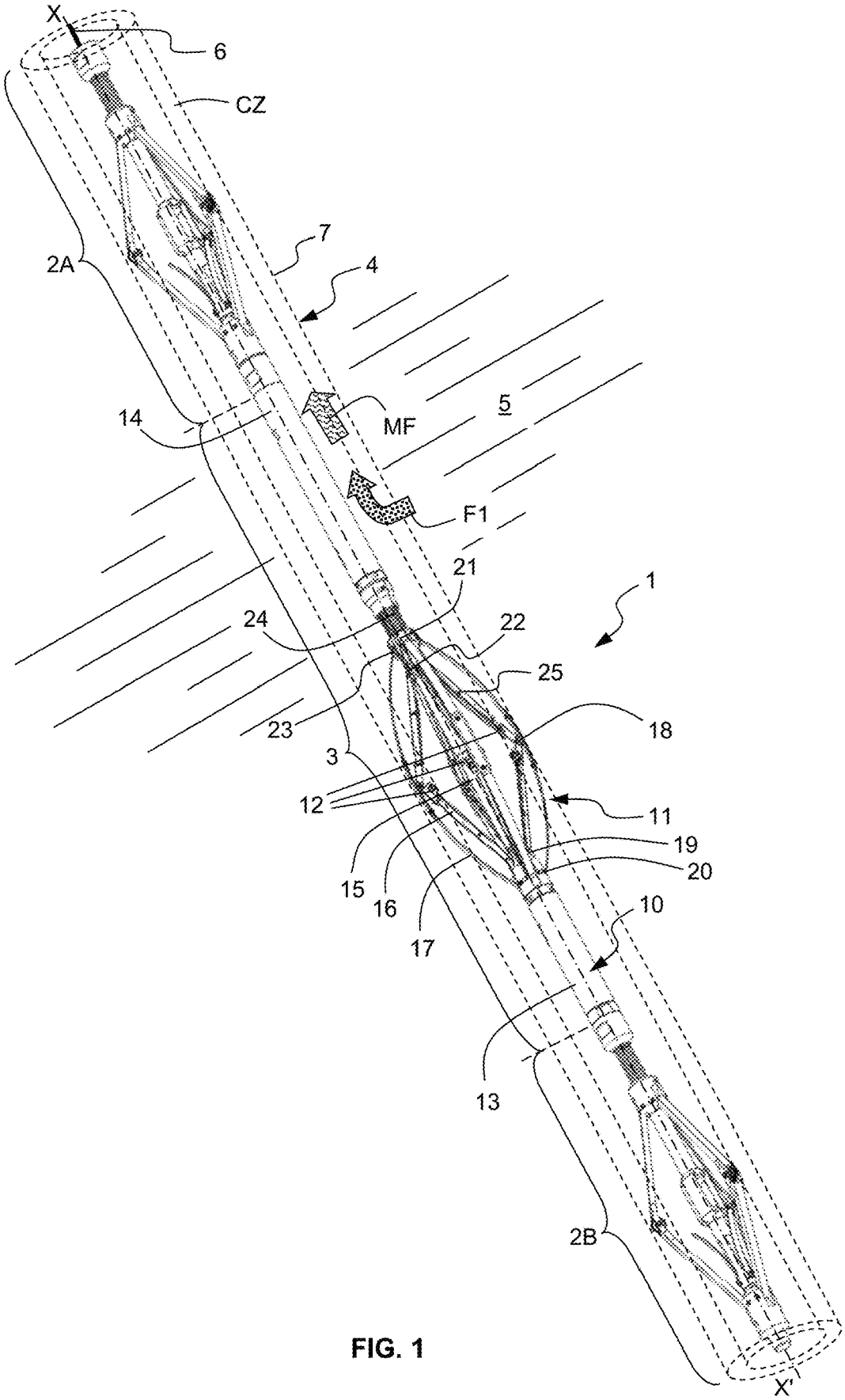
FIG. 1 illustrates a main implementation example of an embodiment of a production logging tool PLT of the invention in a train comprising a first guiding section, a measuring section and a second guiding section.

FIG. 1 is a perspective view schematically illustrating a production logging tool (PLT) 1 deployed into a well bore of a hydrocarbon well 4 that has been drilled into an earth subterranean formation 5. The production logging tool 1 comprises at least one guiding section 2, for example two guiding sections, namely a first 2A and a second 2B guiding section as depicted in FIG. 1, and a measuring section 3 that is used to analyze at least one property of a multiphase flow mixture MF flowing in the hydrocarbon well 4. The well bore refers to the drilled hole or borehole. The borehole refers to the inside diameter of the wellbore wall, the rock face that bounds the drilled hole. The open hole refers to the uncased portion of a well. While most completions are cased, some are open, especially in horizontal wells where it may not be possible to cement casing efficiently. The production logging tool 1 is suitable to be deployed and run in the well bore of the hydrocarbon well 4 for performing various analysis of the multiphase flow mixture MF properties in the hydrocarbon well. The production logging tool 1 comprises various sub sections having different functionalities and may be coupled to surface equipments through a wireline 6 (alternatively a coiled tubing). At least one sub section being herein referred as a measuring section 3 comprises a measuring device generating measurements logs, namely measurements versus depth or time, or both, of one or more physical parameters in or around the well 4. Wireline logs are taken downhole, transmitted through the wireline 6 to surface and recorded there, or else recorded downhole and retrieved later when the instrument is brought to surface. There are numerous log measurements (e.g. electrical properties including conductivity at various frequencies and permittivity, sonic properties, optical properties, active and passive nuclear measurements, dimensional measurements of the wellbore, formation fluid sampling, formation pressure measurement, etc. . . . ) possible while the production logging tool 1 is displaced along and within the hydrocarbon well 4 drilled into the subterranean formation 5. Surface equipments are not shown and described in details herein. In the following the wall of the well bore irrespective of being a cement wall or a metal pipe nature is referred to wall 7. Various fluid (that may include solid particles) entries F1 may occur from the subterranean formation 5 towards the well bore 4. Once in the well bore 4, these fluid forms a multiphase flow mixture MF that generally is driven to flow towards the surface. In particular, in deviated or horizontal wells, the multiphase fluid mixture MF may be segregated. For example, the segregated multiphase flow mixture MF may flow as a layer of gas above a layer of oil, further above a layer of oil and water mixture from top to bottom (i.e. in the direction of earth gravity).

The measuring section 3 and the guiding section 2 of the production logging tool 1 will now be described in details.

Measuring Section 3:

The measuring section 3 of the production logging tool 1 has an elongated cylindrical body shape and comprises a central pressure-resistant rigid housing 10 carrying a centralizer arrangement 11. The production logging tool 1 extends longitudinally about the longitudinal axis XX'. The centralizer arrangement 11 substantially centers the production logging tool 1 with respect to the well bore axis during operations into the well bore, the well bore axis being substantially parallel, generally coincident or mingled with the longitudinal axis XX' of the production logging tool 1. The centralizer arrangement 11 may further position probe 12 tips around a circumference close to the wall 7. Further, when the production logging tool 1 is moved along the well bore, the centralizer arrangement 11 is adapted to fit boreholes of different diameters while offering a minimal frictional resistance as explained hereinafter.

The central pressure-resistant rigid housing 10 comprises, at one end, a first housing part 13 including a master and telemetry electronic module and probe electronic modules, at another end, a second housing part 14 that may include another master and telemetry electronic module and other probe electronic modules, and, centrally, a stem 15 under the form of an elongated, reduced diameter, hollow tube connecting the first and second housing parts 13, 14. As an example, the stem 15 may be connected to the housing parts 13, 14 by welding or a threaded connection. Both first and second housing part 13, 14 may be fitted with a corresponding pin connector connected to the corresponding master and telemetry electronic module, respectively. Various connections enabling data transfer or power transfer between the various electronic components of the various sections are provided. The master and telemetry electronic module may comprise accelerometer and gyrometer sensors which allow the measurement of tool inclination and relative bearing and, consequently, positions of downhole fluid properties analysis probes within the well section with respect to top and bottom.

The centralizer arrangement 11 comprises articulated centralizer arms 16 and associated bows 17. The bows 17 are positioned externally with respect to the articulated centralizer arms 16 and to the stem 15 and enter into contacting engagement with the wall 7 of the hydrocarbon well 4 at outermost portions of the bows. In particular the bows 17 are adapted for a smooth and low frictional drag contact with the wall 7. Each articulated centralizer arm 16 includes a first arm part and a second arm part coupled together by an appropriate pivot connection, e.g. a hinge 18 at one of their ends. The first centralizer arm part and the second centralizer arm part may be identical. The centralizer arms 16 and bows 17 are coupled at a first side to the first housing part 13 of the housing 10 by respective pivot connection, e.g. hinges 19, 20 and at a second side to a sliding sleeve 21 by respective pivot connection, e.g. hinges 22, 23. The sliding sleeve 21 can slide on the stem 15. As an example, the present embodiment comprises a centralizer arrangement 11 including four centralizer arms 16 and their respective bows 17. The four centralizer arms are spaced apart circumferentially about the longitudinal axis XX' of the production logging tool 1. The four centralizer arms may be identical and equally spaced on the circumference. The centralizer arrangement 11 further comprises an axial spring element, e.g. a first coil spring 24 extending around the stem 15 and being disposed in abutment between the second housing part 14 and the sliding sleeve 21.

The centralizer arrangement 11 operates as follows. The coil spring 24 exerts an axial force substantially along the longitudinal axis XX' of the production logging tool 1. The axial forces act onto the sliding sleeve 21 that slides onto the stem 15. Thus, the coil spring 24 causes radial forces that acts on the articulated centralizer arms 16 and associated bows 17 urging them to move radially outwardly toward the wall 7 until an outmost extended position corresponding to the outermost portions of the bows 17 being urged into engagement with the surface of the wall 7. When the production logging tool 1 is run into a hydrocarbon well 4 having diameter that changes, in particular through a restriction of smaller diameter, the wall 7 acts on the articulated centralizer arms 16 and associated bows 17 that are urged to move radially inwardly towards the stem 15. This causes an inwardly oriented axial force acting onto the sliding sleeve 21 that slide onto the stem 15 in the other direction compressing the coil spring 24. In an extreme configuration, the articulated centralizer arms 16 and associated bows 17 may be fully retracted such as being parallel to the stem 15, lying on the stem circumference surface, flush with the external surface of the first and second housing parts 13, 14.

According to the present exemplary embodiment, each centralizer arm 16 may further comprise at least one, for example two, downhole fluid properties analysis probe 12 secured on an internal side (the inner face facing the stem 15) or on a lateral side of the centralizer arm 16 such as to expose a tip of said probe 12 to the multiphase fluid mixture MF flowing in the hydrocarbon well 4, and at the same time protect the tip from a direct harmful contact with the wall 7 by means of the bows 17. Probe attachments 25 at the side of centralizer arms allow positioning the probe tips close to the center of the bow spring in contact with the well bore wall 7 and therefore allows measuring fluid properties close to the wall while being protected from direct contact to the wall by the centralizer arms structure. This configuration allows reducing damage risks on the probes during logging and/or deployment. In the present description, a downhole fluid properties analysis probe 12 may be understood as a set including a probe electronic module, a pressure feedthrough, a protective tube and a tip. The probe electronic module connected to the associated probe is located in the first housing part 13 and/or in the second housing part 14. A protective tube enclosing a link extends from the electronic module to the tip through a pressure feedthrough into said housing part 13, 14. The downhole fluid properties analysis probe 12 may be of any type, namely mechanical, magnetic, optical, electrical, ultrasonic, spinner or mini-spinner, etc. . . . responsive to various physical entities like pressure, temperature, density, viscosity, conductivity, refractive index, fluid velocity, gas bubble and oil droplet counts and holdups, fluorescence, spectroscopic absorption, etc. . . . . For example, in a particular tool configuration, the probes 12 are conductivity probes measuring water holdup, optical probes measuring gas holdup, fluorescence probes measuring oil holdup, and mini-spinner probe measuring fluid velocity. In another exemplary tool configuration, the probes 12 are three phase optical probes measuring gas-oil-water holdups, and ultrasonic doppler probe measuring fluid velocity.

Figure 2:
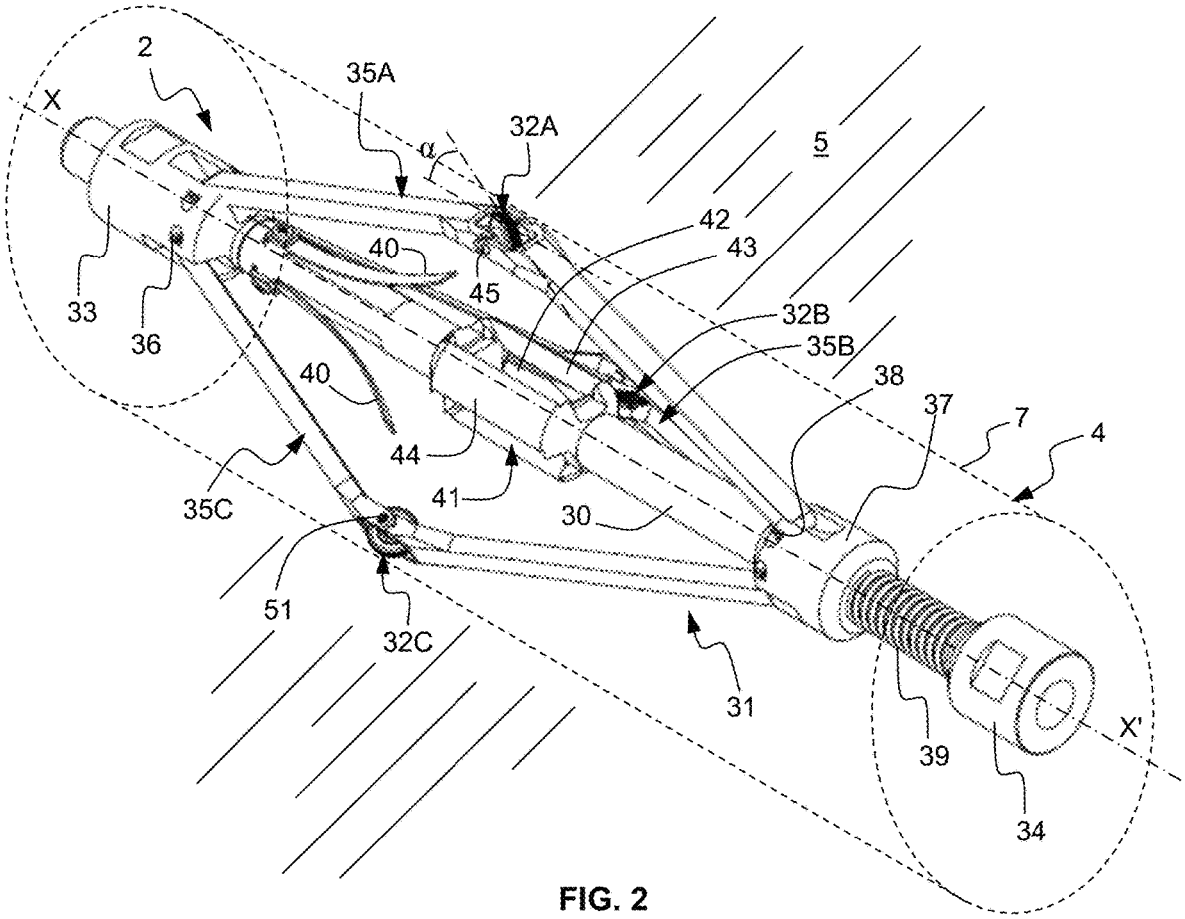
FIGS. 2 to 4 are various perspective views of a guiding section of a production logging tool PLT of the invention according to different viewing angles in a deployed configuration.
Figure 3:
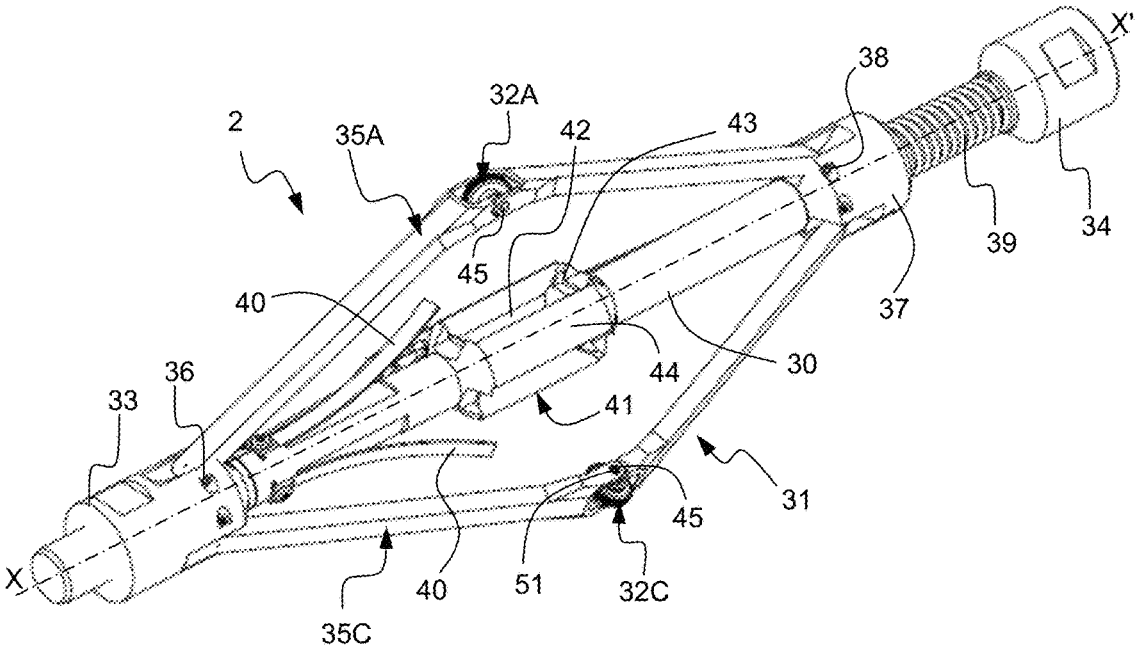
Figure 4:
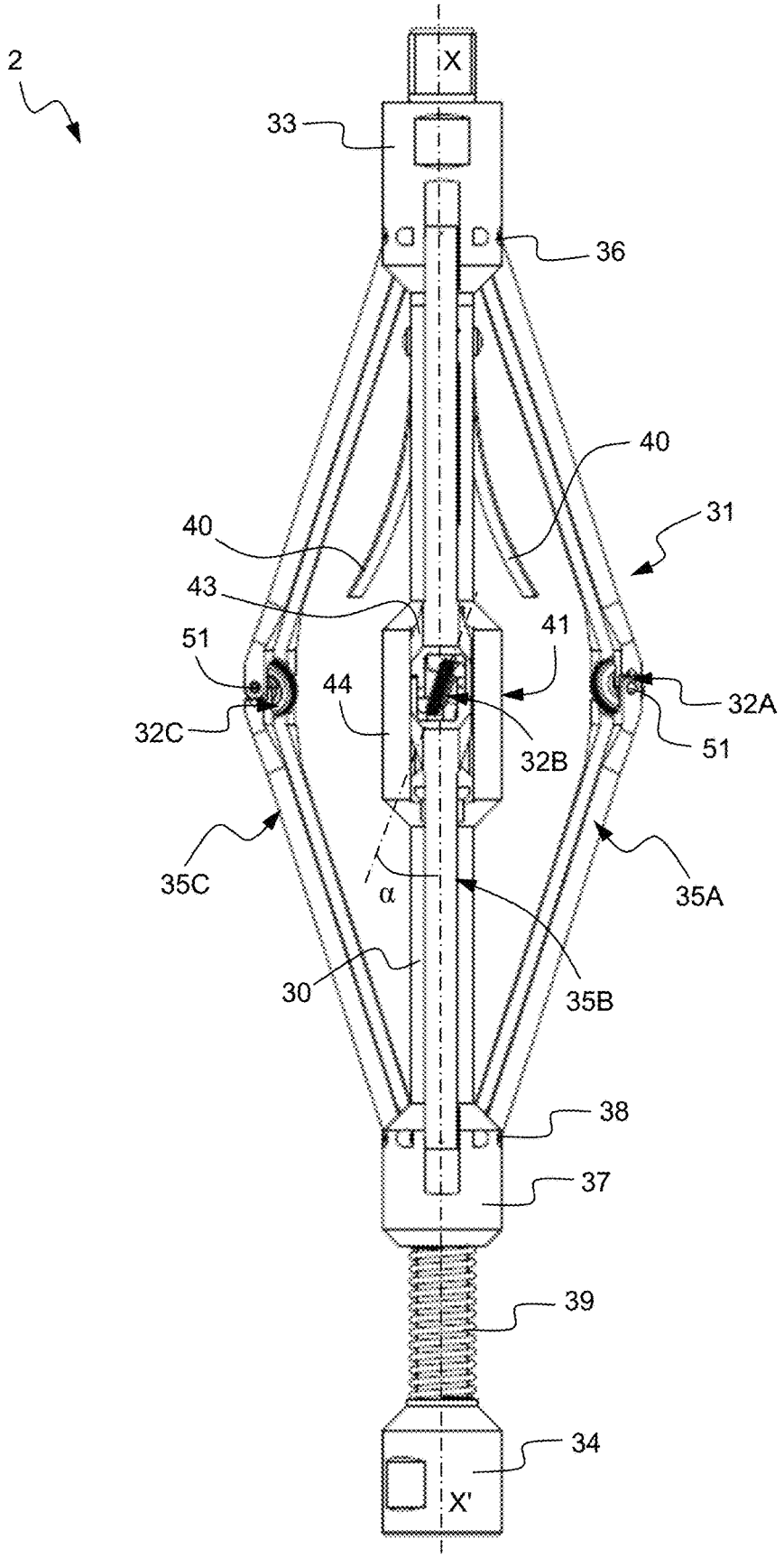
Figure 5:
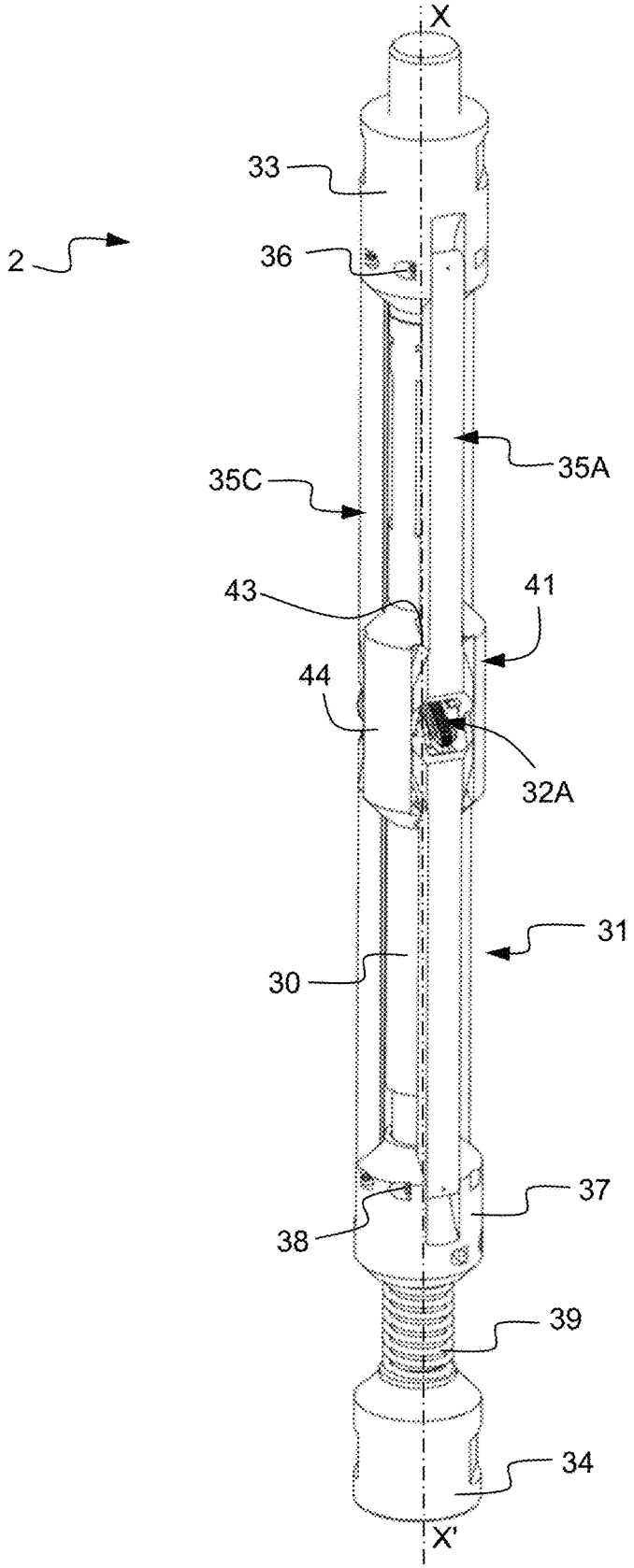
FIG. 5 is a perspective view of the guiding section illustrated in FIGS. 1 to 3 in a retracted configuration.

Guiding Section 2:

The first and second guiding sub-sections 2A, 2B of the production logging tool 1 are depicted in details in FIGS. 2 to 5. In particular, FIGS. 2 to 4 illustrate one guiding section 2 according to different viewing angles in a deployed (radially extended) configuration, and FIG. 5 illustrates a guiding section 2 in a retracted configuration.

The guiding section 2 of the production logging tool 1 has an elongated cylindrical body shape and comprises a central rigid stem 30 carrying a roller deploying arrangement 31. The guiding section 2 extends longitudinally about the longitudinal axis XX'. The roller deploying arrangement 31 in combination with the operation of the centralizer arrangement 11 of the measuring section 3 substantially centers the guiding section 2 of the production logging tool 1 with respect to the well bore axis during operations into the well bore, the well bore axis being substantially parallel, generally coincident with the longitudinal axis XX' of the guiding section 2. The roller deploying arrangement 31 carries roller assemblies 32A, 32B, 32C that are deployed in contact with the wall 7. Further, when the production logging tool 1 is moved along the well bore, the roller deploying arrangement 31 is adapted to fit boreholes of different diameters while offering a good frictional resistance as explained hereinafter.

The central rigid stem 30 is coupled, at one end, to a first mechanical connector 33 and, at another end, to a second mechanical connector 34. The central rigid stem 30 may be a reduced diameter, hollow tube. As an example, the central rigid stem 30 may be coupled to the first and second mechanical connector 33, 34 by welding or a threaded connection. Both first and second mechanical connector 33, 34 may be fitted with a corresponding pin connector enabling data transfer or power transfer between the various electronic components of the other sections, like the measuring section 3 for example, or with the surface via the wireline 6. The central rigid stem 30 and/or the mechanical connectors 33, 34 may comprise accelerometer and gyrometer sensors which allow the measurement of guiding section inclination and relative bearing and, consequently, positions with respect to top and bottom and angular positions of the production logging tool 1 within the well section.

The roller deploying arrangement 31 comprises multiple articulated arms 35, for example three articulated arms 35A, 35B and 35C as depicted. Each articulated arm 35A, 35B and 35C comprises a roller assembly 32A, 32B, 32C corresponding to outermost portions of the articulated arm 35A, 35B and 35C and arranged to enter into contacting and frictional engagement with the wall 7 of the hydrocarbon well 4. Each articulated arm 35A, 35B and 35C includes a first arm part and a second arm part coupled together by the associated roller assembly 32A, 32B, 32C that will be described in details with reference to FIGS. 6 to 8. The first arm part and the second arm part may be identical. Each articulated arm 35A, 35B and 35C is coupled at a first side to the first mechanical connector 33 by pivot connection, e.g. hinge 36 and at a second side to a sliding sleeve 37 by pivot connection, e.g. hinge 38. The sliding sleeve 37 can slide on the central rigid stem 30. The three articulated arms 35A, 35B and 35C are spaced apart circumferentially about the longitudinal axis XX' of the production logging tool 1. The three articulated arms 35A, 35B and 35C may be identical and equally spaced on the circumference of the guiding section 2. The roller deploying arrangement 31 further comprises an axial spring element, e.g. a coil spring 39 extending around the central rigid stem 30 and being disposed in abutment between the second mechanical connector 34 and the sliding sleeve 37.

The roller deploying arrangement 31 further comprises at least one unhooking flexible blade 40 associated with one articulated arm 35, for example three unhooking blades 40 associated with the respective articulated arms 35A, 35B, 35C. Each unhooking blade 40 is secured on one side on the central rigid stem 30 while the other side is free to move and radially bended outwardly toward the wall 7. Each unhooking blade 40 is associated with a respective articulated arm 35A, 35B, 35C such as to initiate or ease the unhooking of the articulated arms 35A, 35B, 35C from the central rigid stem 30 when the guiding section 2 proceeds from a retracted configuration (FIG. 5) to a deployed configuration (FIGS. 2-4).

The roller deploying arrangement 31 further comprises a roller assembly receiving part 41 positioned approximately in the middle of the central rigid stem 30. The roller assembly receiving part 41 is a collar having a radial extension similar to the first and second mechanical connector 33, 34 and to the sliding sleeve 37. The roller assembly receiving part 41 comprises a central recess 42 and at least one longitudinal outward clearance 43 associated with a connecting rib 44 that are arranged on the circumference of the roller assembly receiving part 41 to receive a roller assembly 32 and associated articulated arm 35. In the depicted embodiment, the roller assembly receiving part 41 comprises three longitudinal outward clearances 43 and three associated connecting rib 44. Each of the longitudinal outward clearances 43 emerges internally in the central recess 42. Each end of each connecting rib 44 is secured to the respective part of the central rigid stem 30. The three longitudinal outward clearances 43 may be identical and equally spaced on the circumference of the roller assembly receiving part 41 such as to face the respective roller assembly 32 and associated articulated arm 35. Their positions and sizes are such that the roller assemblies 32 and associated articulated arms 35 can move free of obstruction from the stem 30 towards the wall 7 and vice-versa. Further, in the retracted configuration, the outermost portions of the roller assemblies 32 and associated articulated arms 35 are flush with the first and second mechanical connector 33, 34 and the sliding sleeve 37 as depicted in FIG. 5. Practically, the central recess 42 and the longitudinal outward clearances 43 may be machined in a cylindrical block of metal defining the roller assembly receiving part 41.

Figure 6:
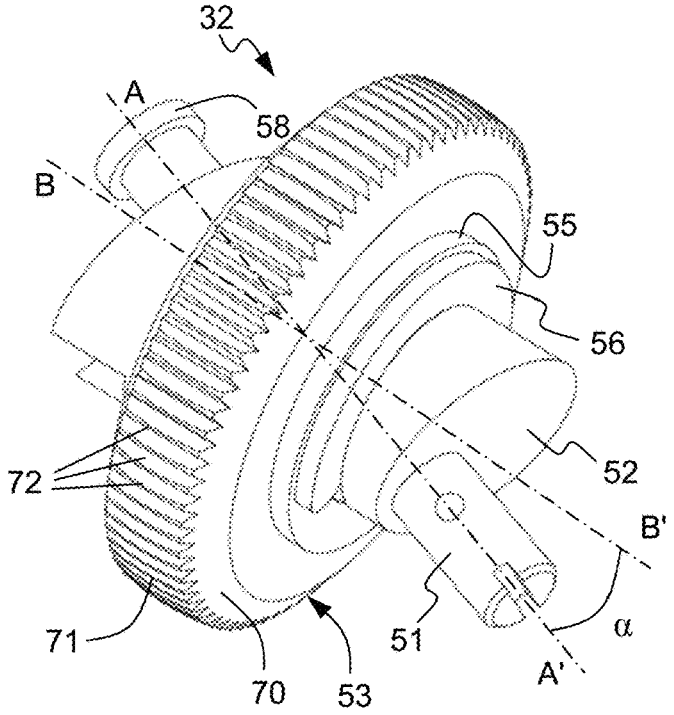
FIGS. 6 to 8 are a one side perspective view, another side perspective view and an exploded perspective view of a roller assembly comprising a first alternative embodiment of an anti-slippage friction roller, respectively.
Figure 7:
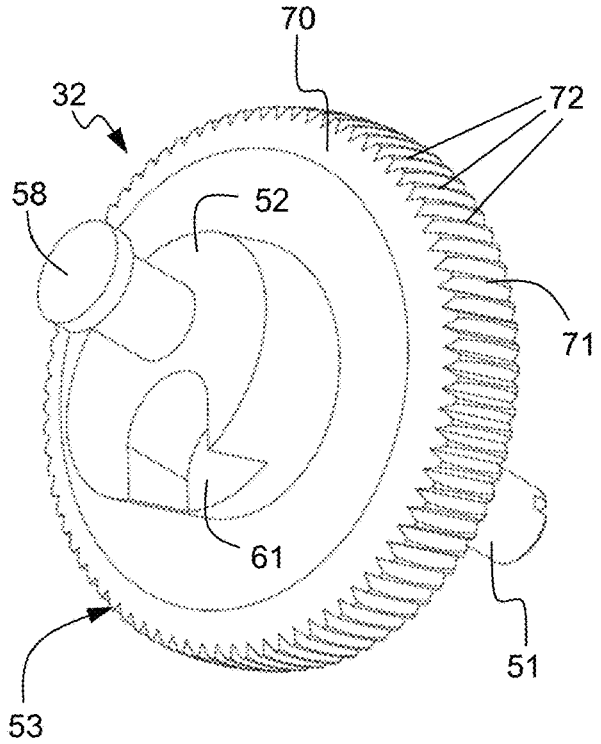
Figure 8:
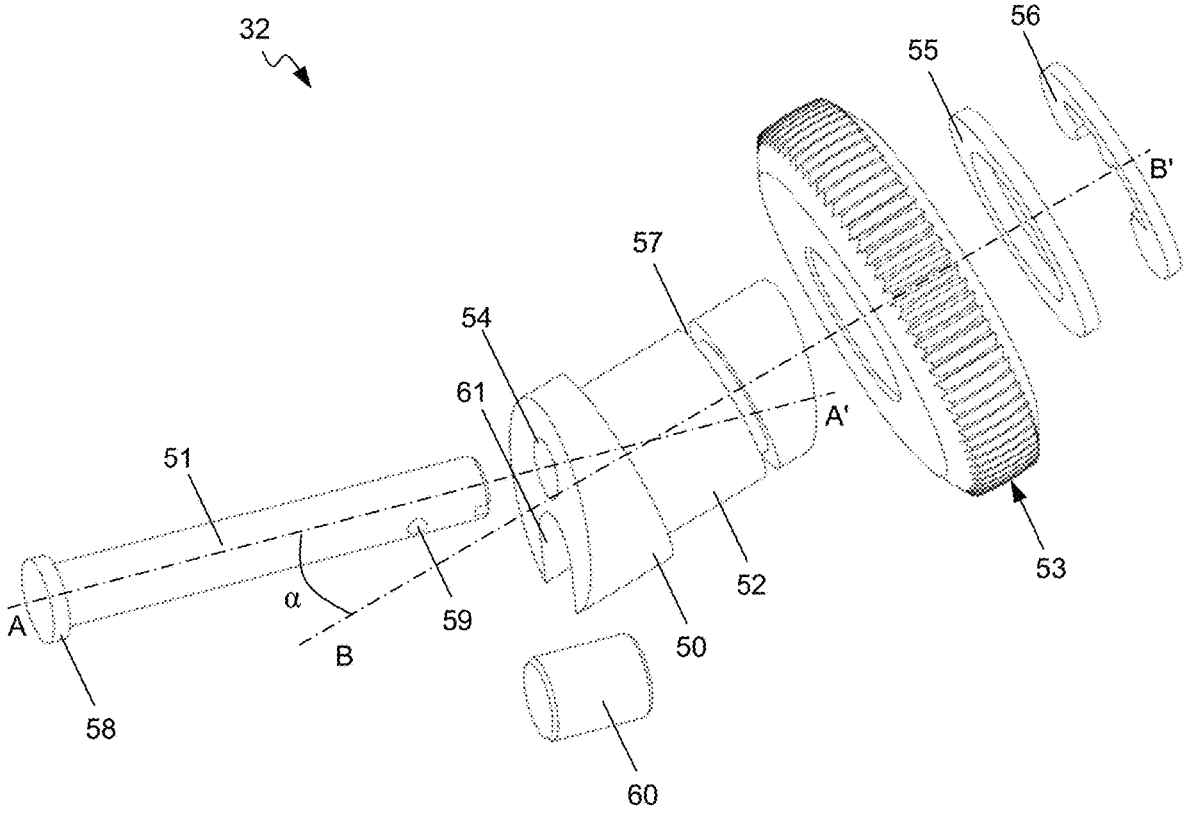

FIGS. 6 and 7 are perspective views of a roller assembly 32. FIG. 8 is an exploded perspective view of a roller assembly 32. All the roller assemblies 32A, 32B, 32C depicted in FIGS. 1-5 are similar. The roller assembly 32 has different functions. A first function is to couple together a first arm part and a second arm part of each articulated arm 35A, 35B and 35C. A second function is to tilt an anti-slippage friction roller with respect to the longitudinal axis XX' and thus to induce an helicoidal rotation movement to the production logging tool 1 while it runs into the hydrocarbon well 4. A third function is to frictionally engage the anti-slippage friction roller with the wall of the well such as to restrain random angular movement of the production logging tool with respect to the wall 7 of the well 4.

The roller assembly 32 comprises an arm hinge 51, a roller bearing 52 and a friction roller 53. The arm hinge 51 defines an arm hinge axis AA' that is generally perpendicular to the longitudinal axis XX'. The roller bearing 52 defines a roller axis BB' that forms an angle $\alpha$ with the hinge axis AA'. The angle $\alpha$ may range from 5° to 25°. The arm hinge 51 secures a first arm part and a second arm part of each articulated arm 35A, 35B and 35C in corresponding holes 45 provided in each of said arms. The arm hinge 51 is blocked in place by a head 58 on one side and hole/pin 59 on the other side. The roller bearing 52 is secured onto the arm hinge 51. More precisely, the roller bearing 52 comprises a through-hole 54 to receive the arm hinge 51. The through-hole 54 is inclined within the roller bearing 52 in order to define the angle $\alpha$. The anti-slippage friction roller 53 is received onto the roller bearing 52 such as to be free to rotate. On one side of the roller bearing 52, a locking pin 60 is provided in an abutting head 50. One end of the locking pin 60 may be partially received in a clearance 61 of the roller bearing. The other end of the locking pin 60 engages a hole into one of the articulated arm 35 part in order to block the rotation of the whole bearing whatever the radial position of the articulated arm 35. In this way, the angle $\alpha$ is set at a determined value. On the other side of the roller bearing 52, a flat ring 55 and a circlip 56 are provided. The circlip 56 is a retaining ring consisting of a semi-flexible metal ring with open ends which can be snapped into place into a machined groove 57 made into the roller bearing 52. The abutting head 50, the flat ring 55 and the circlip 56 block the lateral movement of the anti-slippage friction roller 53 while allowing free rotation of the anti-slippage friction roller 53 about the BB' axis of the roller bearing 52. As an example, the roller bearing 52 can be made of bronze, while the other elements of the roller assembly are made of stainless steel.

Figure 10:
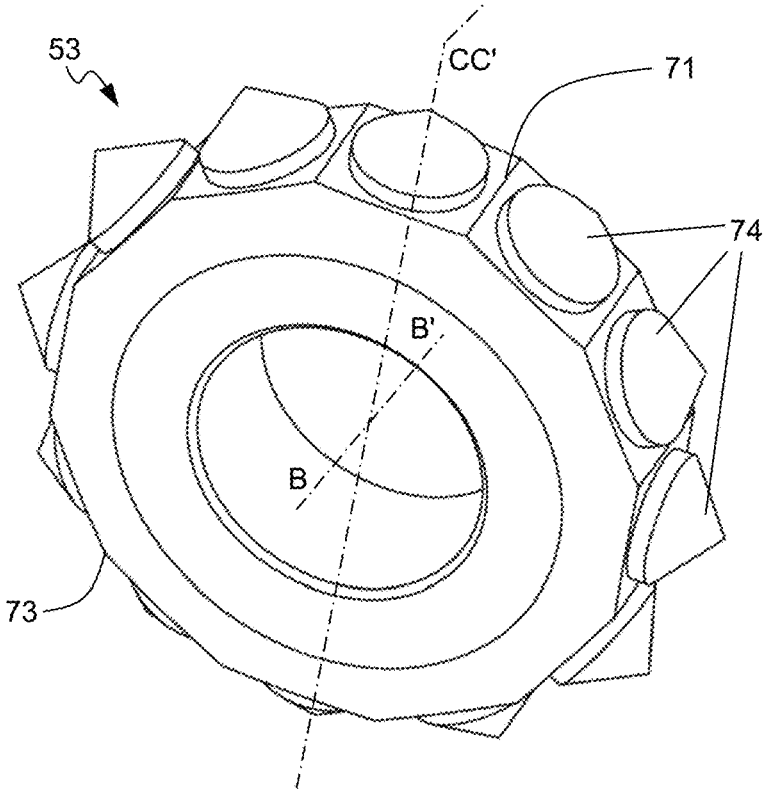
FIGS. 10 and 11 are a one side perspective view and a CC' cross section view, respectively, of a second alternative embodiment of an anti-slippage friction roller.
Figure 11:
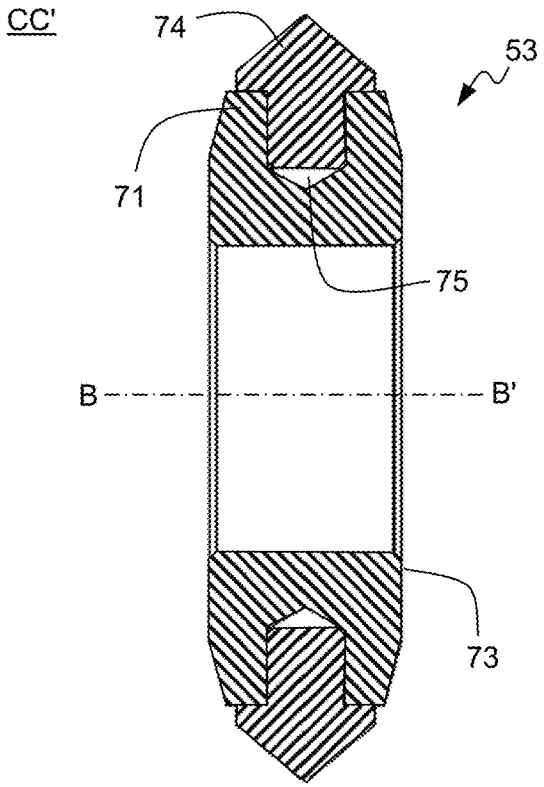

The anti-slippage friction roller 53 may be implemented in the form of various wheel. FIGS. 6 to 8 illustrate a first alternative embodiment wherein the anti-slippage friction roller 53 is implemented in the form of a notched wheel 70. A notched wheel 70 is a wheel having notches 72 on a wheel peripheral surface 71. The notches extend parallelly relatively to the roller axis BB'. FIGS. 10 and 11 illustrate a second alternative embodiment wherein the anti-slippage friction roller 53 is implemented in the form of a toothed wheel 73 comprising multiple teeth 74 on the wheel peripheral surface 71. The teeth extend radially relatively to the roller axis BB'. For example, each tooth 74 is removable, e.g. by being screwed in a corresponding threaded cavity 75. As further alternatives, the teeth may be spikes or pins. Such notches, tooth, spikes and pins offer a good frictional engagement with the surface of the wall 7. A good frictional engagement means that the notches, tooth, spikes and pins may be able to bite on (i.e. engage) the surface of the wall 7 without damaging the wall. Thus, lateral shifting or lateral slippage of the wheel against the surface of the wall 7 is prevented, at least reduced in an important manner. The wheel is therefore an anti-slippage wheel that is adapted to the particular harsh downhole conditions of hydrocarbon wells.

The roller deploying arrangement 31 operates as follows. The coil spring 39 exerts an axial force substantially along the longitudinal axis XX' of the guiding section 2 of the production logging tool 1. The axial forces act onto the sliding sleeve 37 that slides onto the central rigid stem 30. Thus, the coil spring 39 causes radial forces that acts on the articulated arms 35A, 35B, 35C urging them to move radially outwardly toward the wall 7 until an outmost extended position corresponding to the roller assemblies 32A, 32B, 32C being urged into engagement with the surface of the wall 7. The articulated arms take off can be helped by the action of the unhooking blades 40. When the production logging tool 1 is run into a hydrocarbon well 4 having diameter that changes, in particular through restriction of smaller diameter, the wall 7 acts on the roller assemblies 32A, 32B, 32C and the articulated arms 35A, 35B, 35C that are urged to move radially inwardly towards the central rigid stem 30. This causes an inwardly oriented axial force acting onto the sliding sleeve 37 that slide onto the central rigid stem 30 in the other direction compressing the coil spring 39. In an extreme configuration, the roller assemblies 32A, 32B, 32C and the articulated arms 35A, 35B, 35C may be fully retracted such as being parallel to the central rigid stem 30. In this retracted configuration, the articulated arms 35A, 35B, 35C lies on the stem circumference surface, flush with the external surface of the first and second mechanical connector 33, 34, while the roller assemblies 32A, 32B, 32C are received in the central recess 42 and the longitudinal outward clearances 43. The operation of the roller deploying arrangement 31 of each guiding sub-section 2 is independent to the operation of the centralizer arrangement 11 of each measuring sub-section 3, in the sense that in a long train of sub-sections, each sub-section adapts its respective radial extension to the well bore dimension where it is positioned. Thus, transition in the diameter of the well bore can be passed smoothly.

Figure 9:
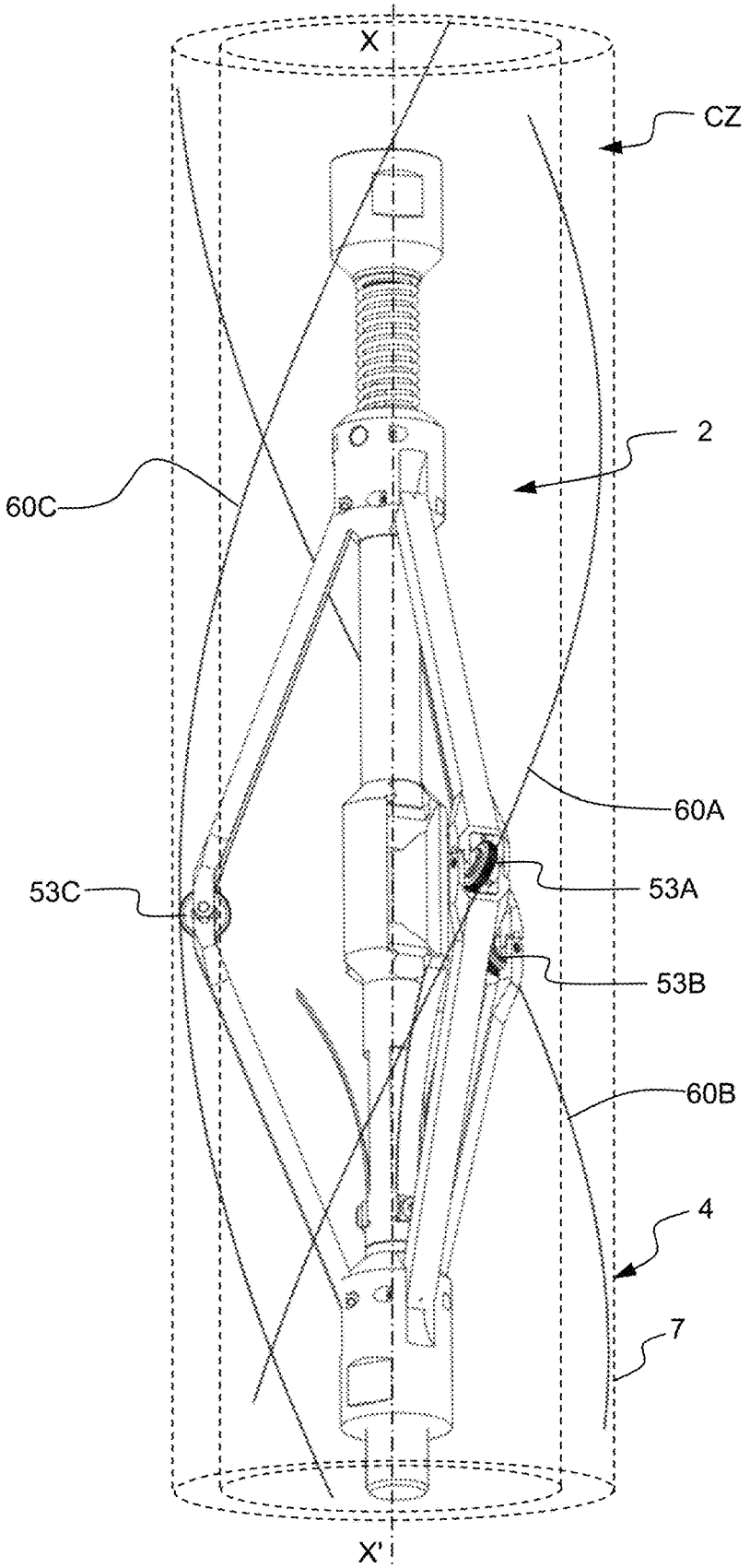
FIG. 9 illustrates the helicoidal movement of one of the guiding sections illustrated in FIG. 1.

The roller assembly 32 operates as follows. Reference is made to FIG. 9 that illustrates the helicoidal movement of the guiding section 52 caused by the operation of the roller assembly 32. In particular, the trajectories 60A, 60B, 60C of each respective anti-slippage friction roller 53A, 53B, 53C is depicted.

The roller bearing 52 defines a roller axis BB' that forms an angle $\alpha$ with the hinge axis AA'. This causes the anti-slippage friction roller 53 to be orientated according to the angle $\alpha$ with respect to the longitudinal axis XX'. Due to this tilting of the anti-slippage friction roller 53 with respect to the longitudinal axis XX' and the frictional engagement of the anti-slippage friction roller 53 with the wall 7, a helicoidal rotation movement is induced to the guiding section 2, and thus to the whole production logging tool 1 when the production logging tool 1 is run into the hydrocarbon well 4.

The angle $\alpha$ is chosen in a range from 5° to 25° in order to define the rotation path (i.e. the length to be run through in order to achieve a complete 360° tour) and to adapt the rotation path to specific production conditions. The rotation path may be approximated by the formulae $L_{360°}=(\pi\times\text{well bore-pipe diameter})/\tan\alpha$. As examples, a complete 360° tour for an angle $\alpha$ of 18° is obtained in approximately 97 cm for well bore-pipe diameter of 10 cm (approximately 4"), in approximately 193 cm for well bore-pipe diameter of 20 cm (approximately 8"), in approximately 242 cm for well bore-pipe diameter of 25 cm (approximately 10").

According to the present embodiment depicted in FIG. 9, the rotational movement of the whole production logging tool 1 is obtained in a passive manner. The production logging tool 1, when run, helicoidally rotates about its longitudinal axis under the combined effects of the angle $\alpha$ of the anti-slippage friction roller 53 and of the friction of the anti-slippage friction roller 53 on the wall 7. The mechanical coupling between the guiding section 2 and measuring section 3 enables the measuring section 3 to follow the movement imposed by the guiding section 2. Thus, the helicoidal movement of the guiding section 2 causes the measuring section 3 to have the same helicoidal movement. In practice, the tips of the probe 12 of the measuring section 3 follow trajectories similar to the trajectories 60A, 60B, 60C. This enables exposing the tip of the probe 12 of the measuring section 3 to the multiphase fluid mixture MF flowing in the hydrocarbon well with a robust control of its radial and angular position. Further, the helicoidal movement of the tip of the probe 12 enables scanning an important sector with a few numbers of probes 12 and, thus, substantially improves the resolution of the production logging tool according to the invention. In particular, this results in the probes 12 sweeping the circumferential zone CZ of the well in a controlled manner. Thus, circumferential zone CZ of the hydrocarbon well 4, preferably close to the wall 7 can be analyzed. This gives important information about the flow regime in particular in horizontal and deviated hydrocarbon well section where segregated flow regime can occur.

With the production logging tool of the invention, it is possible to achieve:

High coverage of wellbore section, probe sensors approaching contact with wall to detect presence of ultra thin phases flowing at the top or bottom of the well bore.

Fluid identification measurements can be focused on area of pipe section with most interest such as phases interfaces for accurate holdups imaging.

Velocity measurements can be focused on area of pipe section with minimal perturbations, in the bulk of phases away from interfaces.

Minimal perturbation of flow from tool structure is obtained thanks to the original mechanical structure of the tool.

Integrated inclination and azimuth.

Interchangeable roller assemblies and probes in order to adapt to specific production issues. The production logging tool can be installed with particular angle in order to define the complete 360° tour path length, and indifferently with conductive, capacitive, optical reflection, optical fluorescence, active ultrasonics, passive ultrasonics, high resolution temperature sensors.

Design compatible with all types of probe sensor such as electrical, optical, ultrasonic, high resolution temperature.

Robust design allowing deployment in openhole sections.

Operation in memory mode for operations where electrical cable telemetry is not available such as coiled tubing deployment.

Motorless operation of production logging tool helicoidal movement.

The production logging tool structure of the invention is simple, compact achieving low cost and easy operation and maintenance.

It should be appreciated that embodiments of the production logging tool according to the present invention are not limited to the embodiment showing deviated or vertical hydrocarbon well bore, the invention being also applicable whatever the configuration of the well bore, namely vertical, deviated or a succession of vertical, deviated and/or horizontal portions, cased or uncased. Also, the guiding section of the invention is not limited to an application into a production logging tool, but can be easily adapted to various applications into analysis tools operating at downhole pressure and temperature conditions, e.g. a downhole fluid analysis tool, a wireline tool, a formation tester. Despite the fact that the illustrated production logging tool comprises two guiding sections on both side of a unique measuring section, the principle of the invention would be equally applicable to one unique guiding section and/or multiple measuring sections coupled together.

The invention claimed is:

1. A guiding sub-section of a production logging tool, the production logging tool comprising a measuring sub-section provided with at least one probe to analyze at least one property of a multiphase fluid mixture flowing in a hydrocarbon well while said tool is displaced along and within the well, said measuring sub-section in frictional engagement with a wall of the well, the guiding sub-section has an elongated cylindrical body shape along a longitudinal axis and comprises a central rigid stem having a first mechanical connector at one end and a second mechanical connector at another end, at least one being arranged to be coupled with said measuring sub-section, and carrying a roller deploying arrangement comprising multiple external articulated arms circumferentially distributed about said body, each articulated arm comprising a roller assembly adapted for contact with a wall of the hydrocarbon well and operable from a retracted configuration into a radially extended configuration, the centralizer arms being coupled at a first side to the first mechanical connector and at a second side to a sliding sleeve arranged to slide on the central rigid stem, an axial spring extending around the central rigid stem and being disposed in abutment between the second mechanical connector and the sliding sleeve, wherein the roller assembly comprises:

an arm hinge coupling a first arm part and a second arm part of each articulated arm and having an arm hinge axis substantially perpendicular to the longitudinal axis;

a roller bearing secured onto the arm hinge and having a roller axis angled with respect to the hinge axis with an angle $\alpha$ set at a determined value alpha corresponding to a complete 360° tour over a determined displacement of the guiding sub-section along the well; and an anti-slippage friction roller received onto the roller bearing in a rotation free manner;

such that running the production logging tool in the hydrocarbon well results in a rotation movement of the guiding sub-section and of the measuring sub-section of the production logging tool about the longitudinal axis.

2. The guiding sub-section of claim 1, wherein the roller axis is angled with respect to the hinge axis according to the angle $\alpha$ ranging from 5° to 25°.

3. The guiding sub-section of claim 2, wherein the roller bearing comprises an inclined through-hole to receive the arm hinge such as to set the angle $\alpha$.

4. The guiding sub-section of claim 2, wherein the roller bearing comprises an abutting head laterally blocking one side of the anti-slippage friction roller, the abutting head being provided with a locking pin engaging a hole into one part of the associated articulated arm such as to block the rotation of the roller bearing and set the angle $\alpha$ at a determined value.

5. The guiding sub-section of claim 1, wherein a flat ring and a retaining ring are provided at another side of the anti-slippage friction roller, the retaining ring being snapped into place into a machined groove in the roller bearing laterally blocking the another side of the anti-slippage friction roller.

6. The guiding sub-section of claim 1, wherein the arm hinge secures in place the first arm part and the second arm part of each articulated arm by a head on one side and hole/pin on the other side.

7. The guiding sub-section of claim 1, wherein the anti-slippage friction roller is a notched wheel, or a wheel comprising multiple teeth, or a wheel comprising multiple spikes, or a wheel comprising multiple pins so as to have a frictional engagement with the surface of the wall.

8. The guiding sub-section of claim 1, further comprising an unhooking blade having an end secured to the central rigid stem and associated with a respective articulated arm and arranged to initiate or ease the unhooking of the articulated arms from the central rigid stem when the guiding sub-section proceeds from a retracted configuration to the radially extended configuration.

9. The guiding sub-section of claim 1, further comprising a roller assembly receiving part positioned approximately in the middle of the central rigid stem having a collar shape and comprising a central recess and at least one longitudinal outward clearance associated with a connecting rib that are arranged on the circumference of the roller assembly receiving part to receive a roller assembly and its associated articulated arm.

10. A production logging tool to analyze at least one property of a multiphase fluid mixture flowing in a hydrocarbon well while said tool is displaced along and within the well, comprising at least one measuring sub-section having an elongated cylindrical housing shape and comprising a central pressure-resistant rigid housing carrying a centralizer arrangement including a plurality of centralizer arms circumferentially distributed about said housing and operable from a retracted position into a radially extended position, said measuring sub-section in frictional engagement with a wall of the well, at least one downhole fluid properties analysis probe being secured on an inner or lateral face of each centralizer arm such as to expose a tip of said, at least one, probe to the multiphase fluid mixture flowing in the hydrocarbon well, wherein the production logging tool further comprises at least one guiding sub-section having an elongated cylindrical body shape along a longitudinal axis and comprising a central rigid stem having a first mechanical connector at one end and a second mechanical connector at an another end, at least one being arranged to be coupled with said measuring sub-section, and carrying a roller deploying arrangement comprising multiple external articulated arms circumferentially distributed about said body, each articulated arm comprising a roller assembly adapted for contact with a wall of the hydrocarbon well and operable from a retracted configuration into a radially extended configuration, the centralizer arms being coupled at a first side to the first mechanical connector and at a second side to a sliding sleeve arranged to slide on the central rigid stem, an axial spring extending around the central rigid stem and being disposed in abutment between the second mechanical connector and the sliding sleeve, wherein the roller assembly comprises:

an arm hinge coupling a first arm part and a second arm part of each articulated arm and having an arm hinge axis substantially perpendicular to the longitudinal axis;

a roller bearing secured onto the arm hinge and having a roller axis angled with respect to the hinge axis with an angle $\alpha$ set at a determined value alpha corresponding to a complete 360° tour over a determined displacement of the guiding sub-section along the well; and an anti-slippage friction roller received onto the roller bearing in a rotation free manner;

such that running the production logging tool in the hydrocarbon well results in a rotation movement of the guiding sub-section and of the measuring sub-section of the production logging tool about the longitudinal axis.

11. The production logging tool of claim 10, wherein the roller axis is angled with respect to the hinge axis according to the angle $\alpha$ ranging from 5° to 25°.

12. The production logging tool of claim 11, wherein the roller bearing comprises an inclined through-hole to receive the arm hinge such as to set the angle $\alpha$.

13. The production logging tool of claim 11, wherein the roller bearing comprises an abutting head laterally blocking one side of the anti-slippage friction roller, the abutting head being provided with a locking pin engaging a hole into one part of the associated articulated arm such as to block the rotation of the roller bearing and set the angle $\alpha$ at a determined value.

14. The production logging tool of claim 10, wherein a flat ring and a retaining ring are provided at another side of the anti-slippage friction roller, the retaining ring being snapped into place into a machined groove in the roller bearing laterally blocking the another side of the anti-slippage friction roller.

15. The production logging tool of claim 10, wherein the arm hinge secures in place the first arm part and the second arm part of each articulated arm by a head on one side and hole/pin on the other side.

16. The production logging tool of claim 10, wherein the anti-slippage friction roller is a notched wheel, or a wheel comprising multiple teeth, or a wheel comprising multiple spikes, or a wheel comprising multiple pins so as to have a frictional engagement with the surface of the wall.

17. The production logging tool of claim 10, further comprising an unhooking blade having an end secured to the central rigid stem and associated with a respective articulated arm and arranged to initiate or ease the unhooking of the articulated arms from the central rigid stem when the guiding sub-section proceeds from a retracted configuration to the radially extended configuration.

18. The production logging tool of claim 10, further comprising a roller assembly receiving part positioned approximately in the middle of the central rigid stem having a collar shape and comprising a central recess and at least one longitudinal outward clearance associated with a connecting rib that are arranged on the circumference of the roller assembly receiving part to receive a roller assembly and its associated articulated arm.

19. A method of deploying a production logging tool in a hydrocarbon well, comprising the steps of:

providing a production logging tool extending along a longitudinal axis comprising a measuring sub-section and a guiding sub-section coupled to said measuring sub-section, the measuring sub-section carrying a centralizer arrangement including a plurality of centralizer arms circumferentially distributed about said longitudinal axis and operable from a retracted position into a radially extended position of engagement with a wall of the well, said measuring sub-section in frictional engagement with a wall of the well, at least one downhole fluid properties analysis probe being secured on an inner or lateral face of each centralizer arm such as to expose a tip of said, at least one, probe to a multiphase fluid mixture flowing in the hydrocarbon well, the guiding sub-section carrying a guiding arrangement including a plurality of articulated arms circumferentially distributed about said longitudinal axis and operable from a retracted position into a radially extended position of engagement with a wall of the well, the articulated arms having respective radially outermost portions comprising roller assemblies configured to frictionally engage the wall of the well, running the production logging tool along the well while operating the centralizer arms and the articulated arms to radially extend into engagement with the wall of the well and to cause anti-slippage friction between said outermost portions comprising roller assemblies of the articulated arms and the wall of the well, said outermost portions comprising roller assemblies of the articulated arms are configured to cause the production logging tool to rotate around the longitudinal axis as a result of said friction around an axis angled with respect to the longitudinal axis of the production logging tool and of the running of the production logging tool along the well.

* * * * *